United States Patent [19]

Cole

[11] Patent Number: 4,585,433

[45] Date of Patent: Apr. 29, 1986

[54] SAMPLE CONTAINER FOR A TOP LOADING SWINGING BUCKET CENTRIFUGE ROTOR

[75] Inventor: Paul M. Cole, Wilmington, Del.

[73] Assignee: E. I. Du Pont de Nemours and Company, Wilmington, Del.

[21] Appl. No.: 656,644

[22] Filed: Oct. 1, 1984

[51] Int. Cl.[4] ..... B04B 5/02

[52] U.S. Cl. ..... 494/20; 215/228; 215/305

[58] Field of Search ..... 494/20, 16, 17, 21; 215/329, 228, 302, 305; 422/72

[56] References Cited

U.S. PATENT DOCUMENTS

| | | | |
|---|---|---|---|
| 1,324,896 | 12/1919 | Hettinger | 215/302 |
| 1,839,944 | 7/1928 | Barthels . | |
| 1,997,919 | 4/1935 | Strezynski . | |
| 2,834,541 | 5/1958 | Szent-Gyorgyi et al. . | |
| 3,266,718 | 8/1966 | Stahl et al. . | |
| 3,361,343 | 1/1968 | Lerner . | |
| 3,377,021 | 4/1968 | Fox et al. . | |
| 3,393,864 | 1/1966 | Galasso et al. . | |
| 3,456,876 | 7/1969 | McEwen . | |
| 3,459,369 | 8/1969 | Marks . | |
| 3,635,370 | 1/1972 | Romanauskas . | |
| 3,720,502 | 3/1973 | Gropper . | |
| 3,752,390 | 8/1973 | Chulay . | |
| 3,938,735 | 2/1976 | Wright et al. . | |
| 3,997,105 | 12/1976 | Hayden et al. . | |
| 3,998,383 | 12/1976 | Romanauskas et al. . | |
| 4,076,170 | 2/1978 | Chulay et al. . | |
| 4,087,043 | 5/1978 | Anderson et al. . | |
| 4,385,707 | 5/1983 | Leiter | 215/305 |
| 4,400,166 | 8/1983 | Chulay et al. . | |
| 4,435,167 | 3/1984 | Stower . | |

FOREIGN PATENT DOCUMENTS

| | | |
|---|---|---|
| 1782602 | 3/1972 | Fed. Rep. of Germany . |
| 296421 | 2/1984 | Switzerland . |
| 505446 | 5/1939 | United Kingdom . |

*Primary Examiner*—Robert W. Jenkins

[57] ABSTRACT

A sample container for a swinging bucket centrifuge rotor is characterized by a planar pivot surface that is adapted to engage in a supported relationship with each of a pair of knife-like pivot edges. The edges engage the surface along an interrupted line contact that intersects the axis of the container.

20 Claims, 4 Drawing Figures

10
14
16
18
22
24
26
28
30
32
34
38
42
47
48
48A
50
52
54
56
58
60
62
64
66
68
70
74
76
92
93
94
98
100
101
102
104
106
108
110
116
118
122
123
S
M

SAMPLE CONTAINER FOR A TOP LOADING SWINGING BUCKET CENTRIFUGE ROTOR

FIELD OF THE INVENTION

This invention relates to a sample container for use with a top loading centrifuge rotor of the swinging bucket type and, in particular, to a container having a planar pivot surface thereon.

CROSS-REFERENCE TO RELATED APPLICATIONS

Subject matter disclosed herein is disclosed in the following copending applications:

Top Loading Swinging Bucket Centrifuge Rotor Having Knife Edge Pivots, Ser. No. 656,645. filed Oct. 1, 1984; and Centrifuge Rotor Having A Load Transmitting Arrangement, Ser. No. 656,646, filed Oct. 1, 1984.

DESCRIPTION OF THE PRIOR ART

A centrifuge rotor of the type in which a sample container carrying a sample of the material to be centifuged moves from an initial position in which the axis of the sample container is substantially parallel to the vertical center line of the rotor to a second position in which the axis of the sample container lies substantially in a plane perpendicular to the vertical center line of the rotor is known as a swinging bucket rotor.

In one typical arrangement, the sample container, or bucket, used with such rotors typically includes outwardly projecting elements, or trunnion pins, having a portion thereof defining a substantially cylindrical bearing surface. The trunnion pins are typically received in corresponding support arms that are provided with conforming trunnion pin receiving sockets. Alternatively, trunnion pins may be located on the arms with the corresponding sockets being disposed on the container.

In either event the bearing surface on the trunnion pin bears against the surface of the trunnion receiving socket in which it is received throughout the pivotal movement of the sample container from the initial to the second position. The trunnion receiving socket therefore acts both as the surface which supports the bearing surface on the trunnion pin and the constraining and guiding surface which insures the controlled movement of the sample container from the initial to the second positions. U.S. Pat. No. 4,400,166 (Chulay et al.), U.S. Pat. No. 3,393,864 (Galasso et al.), U.S. Pat. No. 263,053 (McCollin) and Swiss Pat. No. 296,421 (Willems) disclose typical examples of such rotors.

Trunnion pin systems are generally complex and costly. A sample container should preferably be a lightweight structure to minimize centrifugal loading on the rotor. However, the presence of trunnion pins cantilevered from a sample container requires a substantial anchorage in the container structure, necessitating an undesirable increase in the weight of the container. In addition, when loading the sample container into the rotor the presence of the trunnion pins require locating the container in a precise orientation with respect to the rotor. This can present, at a minimum, an inconvenience to an operator. Moreover, as is developed herein, misorienting the container with respect to the rotor can have more deleterious consequences.

The abrading action which occurs between the bearing surface on the trunnion pin and the socket is also believed to be disadvantageous for several reasons. First of all, the abrasion results in the wearing of metal which must be closely monitored. To counteract this result different materials are used for the pins and the supports. Furthermore, trunnion pins require the structures exhibit relatively large radii in order to reduce trunnion stress and contact stress.

In U.S. Pat. No. 4,435,167 (Stower) an alternative support arrangement is disclosed which eliminates the above-discussed abrading action by use of a rolling profile to engender rolling action between one or more profiled surfaces. However, such an arrangement appears to prevent orientation of the container with its axis completely parallel to the vertial axis of the rotor. A rolling profile precludes the axis of the sample container from reorienting to a true vertical position after centrifugation. At zero rotational speed the sample container will hang in a true vertical position only if the line of restraint is directly in vertical alignment with the center of gravity of the sample container on the centerline of the container. The line of restraint is that location where the forces acting on the center of mass of the container resist movement. Likewise, under high speed rotation the container will assume a horizontal orientation only if the line of restraint is in the horizontal plane of the center of gravity of the container. Since the center of gravity does not change relative to the axis of the container and the use of a rolling profile does alter the point of restraint relative to this axis, the above requirements are mutually exclusive. Since it is desirable in operation to have the axis of the sample container align with the centrifugal force field, it follows with the Stower structure that as the rotor slows and stops the axis of the container will not hang in a true vertical position. Thus, at least in gradient operations, the possibility of unsettling the gradient in the container exists unless the user, when removing the container, is careful to keep it at the same orientation as existed when the rotor stopped.

Accordingly, in view of the foregoing, it is believed advantageous to provide a mounting arrangement for supporting the pivotal motion of the sample container from the initial to the second positions which eliminates the shifting of the container's line of restraint as exhibited by the prior art.

As alluded to earlier, prior art trunnion systems require that the sample container be accurately oriented and mounted on the trunnions. However, this requirement is not always fulfilled in practice. Thus, sample containers are misplaced on the rotor. The majority of rotor mishaps can be traced to the misorientation of the sample container on the rotor.

Accordingly it is believed to be of further advantage to provide a top loading centrifuge rotor in which the requirement of container orientation with respect to the rotor is totally eliminated. That is, a rotor in which a sample container may be expeditiously inserted without the necessity of verifying the position of the container with respect to the rotor should be significantly advantageous in reducing the occurrence of rotor mishaps.

Furthermore, if such a mounting arrangement is provided which eliminates the disadvantages of prior art trunnion systems it is also believed advantageous to provide a sample container especially configured to complement that arrangement to its fullest advantage.

SUMMARY OF THE INVENTION

The present invention relates to a sample container for use in a top loading centrifuge rotor of the type having a pair of knife-like pivot edges thereon. The container includes a body member having a sample-receiving volume therein. The body carries, at a convenient location thereon, a planar pivot surface which is adapted to operably engage each of the pivot edges for supported pivotal movement from an initial to a second position. Preferably the container includes a cap threadily or otherwise connectable thereto which carries the planar surface. The planar surface preferably engages the knife-like edges along an interrupted line contact that extends diametrically of the cap and intersects the longitudinal axis thereof. Any diametrical dimension of the surface may be aligned with the line contact, thus avoiding the necessity of orienting the container with respect to the rotor. The cap may, in the preferred case, carry a guide pin arranged to cooperate with a correspondingly guide slot disposed on the rotor at a point radially inwardly of the pivots. The stop pin is also arranged to cooperate with an arresting surface provided at a convenient location on the rotor.

BRIEF DESCRIPTION OF THE DRAWINGS

The invention will be more fully understood from the following detailed description thereof taken in connection with the accompanying drawings which form a part of this application and in which.

DETAILED DESCRIPTION OF THE INVENTION

Figure 1:
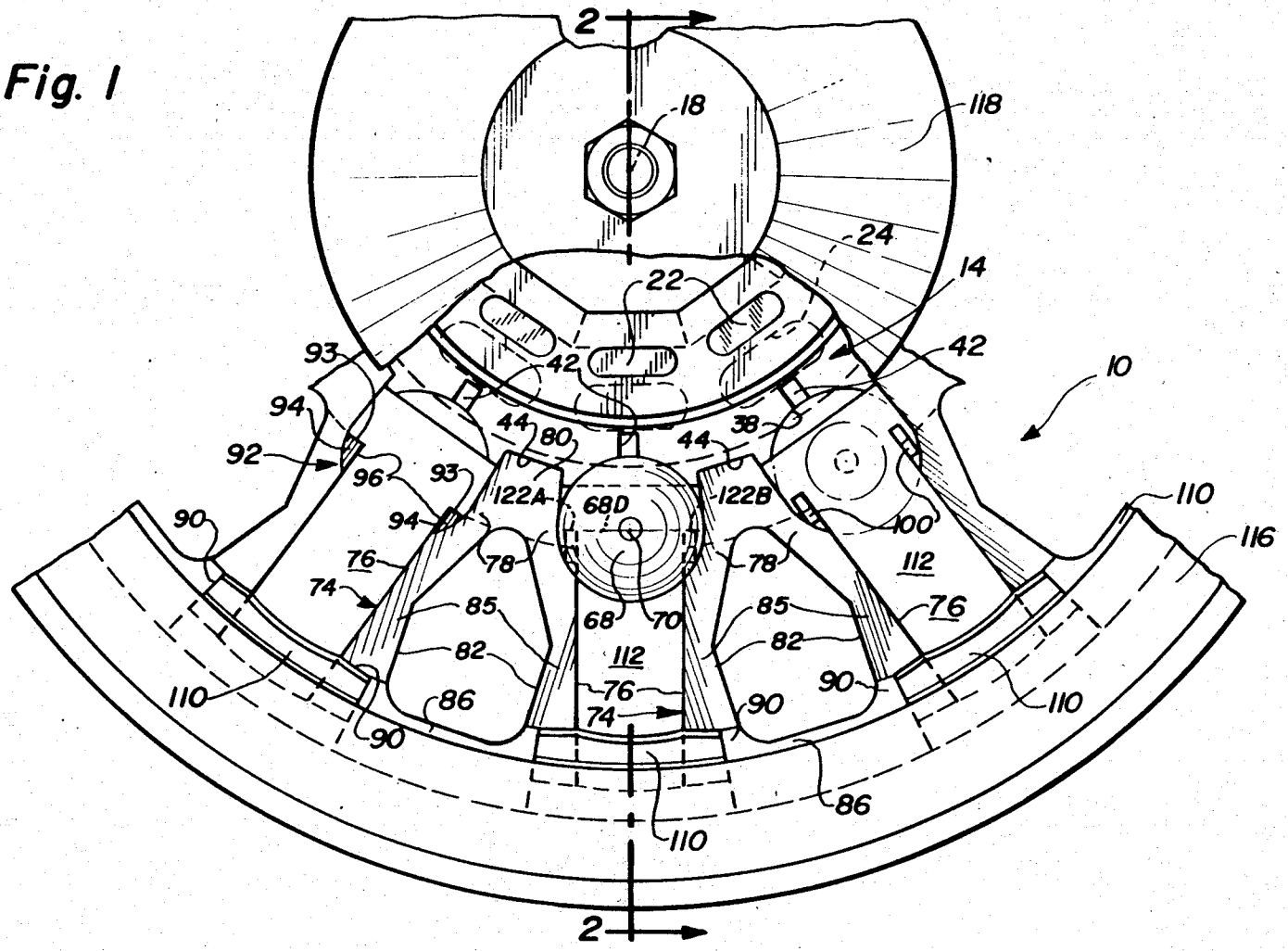
FIG. 1 is a plan view of a top loading swinging bucket centrifuge rotor with which a sample container in accordance with the preferred embodiment of the invention may be used.

Throughout the following detailed description similar reference characters refer to similar elements in all Figures of the drawings.

Figures 2, 3, 4:
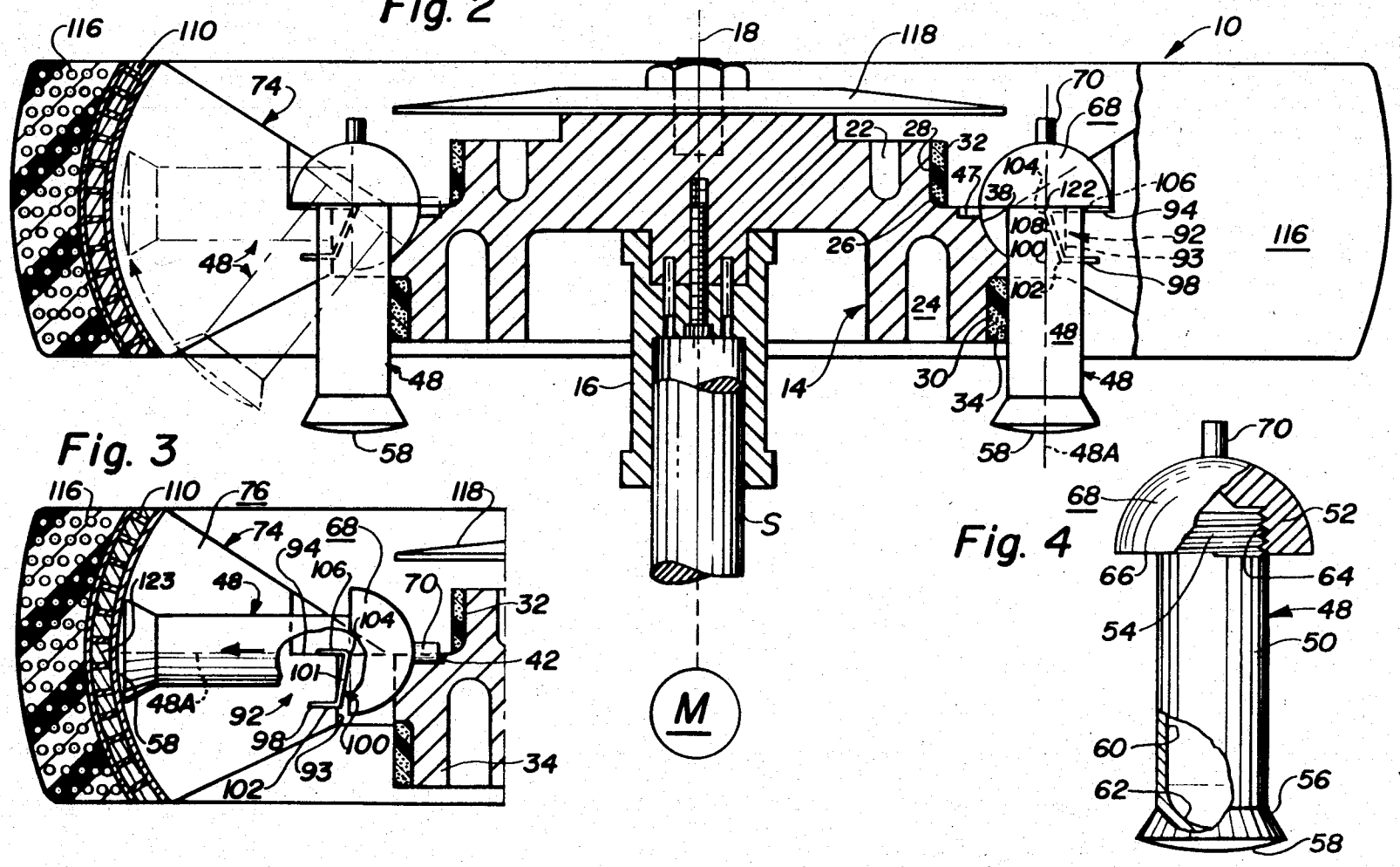
FIG. 2 is a sectional view taken along section lines 2—2 of FIG. 1.
FIG. 3 is a detailed view of a portion of FIG. 2.
FIG. 4 is an elevational view of the sample container in accordance with the present invention with portions broken away for clarity.

With reference to FIGS. 1 and 2 respectively shown is a plan view of a portion of a top loading centrifuge rotor generally indicated by reference character 10 with which a sample container 48 embodying the teachings of the present invention may be used.

The rotor 10 includes a generally annular core 14 that receives in driving engagement a drive adapter 16. The drive adapter 16 serves as the interconnecting element through a shaft S whereby the rotor 10 is connected to a centrifuge drive motor M (shown schematically) to rotate the rotor 10 about its vertical axis 18.

The core 14 is fabricated of a material such as aluminum, titanium or plastic. The core 14 serves to locate and transmit torque to those elements (to be described) disposed outwardly therefrom. The core should be as lightweight as possible in order to maximize its strength to weight ratio and to minimize stresses during high speed rotation. To decrease the weight the core 14 is provided with arrays of cutouts 22 and 24 on its upper and lower surfaces respectively. The outer peripheral surface of the core is stepped as at 26 (FIG. 2) to define upper and lower cylindrical portions. Upper cylindrical portion and the lower cylinderical portion are each provided with notches 28 and 30 respectively. Each of the notches receives a supporting wrapping 32 and 34, respectively. The wrappings 32, 34 are fabricated of a composite fiber material such as an aramid fiber manufactured and sold by E. I. du Pont de Nemours and Company under the trademark KEVLAR®. Each fiber is impregnated with a resinous material, such as epoxy or the like, and wrapped to form stress confining wrappings 32, 34 to enhance the strength-to-weight ratio of the core 14. The wrappings 32 and 34 may, of course, not be necessary if the core material is of a sufficiently high-strength material, as titanium.

An array of spherical cutouts 38 is arranged around the periphery of the lower cylindrical portion of the core 14. Communicating with the head of each cylindrical cutout is a substantially cylindrical channel 42. The purpose of the cylindrical channels 42 will be described in more detail herein. Interposed between adjacent ones of the cutouts 38 are rectangular notches 44 (FIG. 1) for a purpose which will be also set forth herein. The number of cutouts 38, channels 42 and notches 44 corresponds to the number of sample containers 12 carried by the centrifuge rotor 10.

Referring to FIG. 4 shown in side elevation with a portion broken away is the sample container 48 in accordance with the present invention. The sample container 48 has a longitudinal axis 48A and includes a substantially cylindrical body portion 50 threadily attached to a cap 52. The body 50 is a substantially tubular member. The body 50 is preferably machined from titanium or other suitable material. The upper end of the body 50 is provided with external threads 54. The lower end of the body portion 50 flares through a frustoconical region 56 to a stress distributing spherical end region 58. The radius of the spherical end 58 matches that of a force distributing member 110 disposed about the outer periphery of the rotor. The interior of the body portion 50 is configured with a cylindrical sidewall 60 having a spherical end 62 which combine to provide a typical test tube shape to the interior of the body 50. Of course, the contour of the interior of the body 50 may take any desired shape.

The cap 52 is a hemispherical member, preferably fabricated from nylon or other suitable material, having an internally threaded bore 64 adapted to receive the external threads 54 of the body 50. The annular planar undersurface 66 of the cap 52 defines a planar pivot surface operative in a manner set forth herein. The exterior surface of the cap 52 defines a surface 68 topped by an axially extending cylindrical stop pin 70. The pin 70 also conveniently serves as a handle for the container 48. The contour of the surface 68 corresponds in shape to the shape of the surface of the spherical cutouts 38 provided in the core 14. Similarly, the exterior contour of the pin 70 conforms to the contour of the cylindrical channels 42 provided in the core 14.

As seen with reference to FIGS. 1 and 2 arranged circumferentially about the core 14 is an array of force transmitting segments 74 preferably formed from a strong, light weight material, such as a polyester engineering thermoplastic resin such as that manufactured by E. I. du Pont de Nemours and Company, and sold under the trademark RYNITE®. Each segment 74 is a substantially sector or wedge shaped member having generally radially extending sidewalls 76 which taper through converging curved portions 78 towards a generally rectangular key portion 80. Each key portion 80 is configured for a close fitting relationship with one of the notches 44 peripherally arranged about the core 14. The segment 74 is cut-out to form a recess 82 to eliminate that extra mass unnecessary to the performance of its pivot support and structural interconnection functions, as will be described. The recess 82 formed on the segment 74 defines a pair of generally radially extending struts 85 joined by an arcuate connecting land 86. The end of each strut 85 is stepped at its radially outer end, as at 90, for a purpose made clear herein.

As perhaps best seen in FIG. 3 in which a portion of the sample container 48 is broken away, each sidewall 76 of a segment 74 is provided with a step 92 defined by a substantially vertical planar shelf 93, a horizontal shelf 94 and a radially planar portion 96 (FIG. 1) extending radially inwardly from sidewall 76. A notch 98 (FIGS. 2 and 3) is provided into the step 92 to receive and to secure one end of a resilient pivot element 100.

The pivot element 100 is formed of a high strength resilient material, such as stainless spring steel or the like, and takes the form when in its developed state of a rectangular strip 101. One end of the strip 101 is inserted into the notch 98 and is secured thereto by any suitable means of attachment. The strip 101 is bent at a lower elbow 102 adjacent the lower surface of the step 92 and slants vertically and radially inwardly to a second, upper, bend 104, whereat the strip 101 is bent backwards to define a portion 106 which overlies the shelf 94 of the step 92. The upper bend 104 of the strip 101 defines a thin knife edge-like pivot support for the sample container 48. The undersurface of the strip 101 intermediate the bends 102 and 104 defines a predetermined clearance space 108 with the vertical planar face 93 of the step 92 for a purpose discussed herein. The knife edge-like pivot support may be defined in a variety of ways. Any alternative constructions whereby the knife edge pivot support is defined are to be understood as lying within the contemplation of the present invention.

The circumferential distance between the radially outer ends of the struts 85 of adjacent segments 74 is closed by a shell-like distributor element 110. The circumferential ends of the shell 110 are received in the steps 90 provided on confronting struts 85 on angularly adjacent segments 74. The inner surface of the distributor shell 110 is concavely spherical, as seen from FIGS. 2 and 3. The shell 110 is preferably fabricated in a honeycomb fashion from perforated sheets of aluminum bounded by solid shaped plates of aluminum. Any other suitable construction may be used.

Adjacent segments 74 are keyed into the corresponding notches 44 on the core 14 to define the circumferentially spaced array thereof. The spaces between confronting surfaces 76 of angularly adjacent segments 74 together with the distributor 110 cooperate to define a pocket or region 112 adapted to receive and support a sample container 48 during rotation thereof. As discussed herein, the pocket 112 is accessible to an operator for top loading of a sample container 48.

The above structural elements of the rotor are maintained in their described assembled relationship by circumferentially extending band 116 of fiber composite material, such as the aramid fiber similar to that used to form the wrappings 32 and 34. The fiber is uniformly traversed over the dimension of the member through that number of turns required for a given radial depth. The assembly is then placed in an autoclave and the temperature elevated to a suitable level and held for a predetermined time to cure the epoxy. Of course, any other suitable wrapping material and/or means of wrapping or banding the rotor may be utilized. Each segment 74 serves to connect the radially outer distributor plates to the core and thus serves as structural interconnection for the rotor much like the spokes of a wheel interconnect the rim to the hub. A cover 118 may be connected to the rotor, as by a threaded connection, if desired.

In operation, a sample of material to be subjected to a centrifugal force field is introduced into the interior of the sample container 48 and the cap 52 thereof secured to the body portion 50. Sample containers 48 are top loaded in a balanced manner into diametrically opposed ones of the pockets 112 arranged around the periphery of the rotor 10. Each container 48 is supported in its pocket 112 along an interrupted line contact 122 shown in FIG. 1 by the characters 122A and 122B. The interrupted line of contact 122 is defined between the knife edge provided by the upper bends 104 of the pivot support element pair 100 mounted on the step 92 on angularly confronting sidewalls 76 of adjacent segments 74 and the adjacent corresponding portion of the annular undersurface 66 of the cap 52 of the sample container 48. Preferably the line contact 122 so defined preferably extends substantially coincident with a diametrical dimension 68D of the pivot surface 66 of the carrier 48. The dimension 68D intersects the axis 48A of the container 48. Any one of the diametrical dimensions defined across the pivot surface 66 may be coincident with the interrupted line of contact 122. Alternately stated the container 48 may be introduced into the rotor so that any diameter of the pivot surface 66 aligns with the knife edge pivots. The container 48 need not be oriented with respect to the rotor. Thus, the primary cause of mishaps—misalignment of the sample container—is avoided.

With each container 48 in its initial position (as shown in solid lines in FIG. 2) motive force is applied to the rotor causing the same to spin about the vertical axis 18. Increasing rotational speed causes the sample container 48 to pivot on the line contact 122 as above defined and to move from the initial position in which the axis 48A of the sample container 48 lies substantially parallel to the spin axis 18 of the rotor to a second position (shown in dotted lines in the left half of FIG. 2) in which the axis 48A of the container 48 lies in a plane substantially perpendicular to the spin axis 18. Throughout this pivotal motion only the interrupted line contact 122 defined between the undersurface 66 of the head 52 of the sample container 48 and its associated pair of pivot support elements 100 is maintained. Thus, the point of restraint defined by the line contact 122 remains the same throughout the pivotal movement of the container 48. As a result both the abrading contact between the trunnion pins and the sockets and the rolling action present in the various prior art swinging bucket rotors is advantageously avoided.

Throughout its motion from the initial to the second position (shown in dot-dash lines in FIG. 2) the lower spherical end 58 of the container 48 remains radially inwardly of the inner spherical surface of the distributor shell 110. Guidance of the sample container 48 over a portion of its travel from the initial to the second position may be effected by the cooperative interaction of the guide pin on the cap 52 with a guide slot defined between upward and outwardly and radially outwardly slanting fins connected to the hub at each side of the channel 42. Motion of the sample container 48 beyond the second (horizontal) position shown in FIG. 2 is arrested by the engagement of the cylindrical stop pin 70 of the container 48 into the corresponding cylindrical channel 42 provided in the core 14.

The spring element 100 is suitably designed to deflect in such a manner that the container 48 is substantially horizontal before the spherical end of the container 48 contacts the inner spherical surface of the shell 110. As the rotor spins the container 48 pivots while the spring 100 deflects. Once horizontal the increasing centrifugal force on the container 48 continues the deflection of the spring 100 in a radially outwardly direction to close the clearance gap 108 to thereby cause the undersurface of the mid-portion of the pivot element 100 to approach into close adjacency to the vertical face 93 of the step 92. This brings the spherical surface 58 of the sample container 48 into force transmitting contact, shown at 123 (FIG. 3), with the inner surface of the distributor shell 110 and thereby into a force transmissive relationship with the band 116 wrapped around the rotor 10. By judiciously selecting the material and geometry of the container 48 the centrifugal loading on the band 116 from the container 48 through the distributor shell 110 is approximated by the load imposed on the band 116 by the segments 74.

In view of the foregoing, those skilled in the art having the benefit of the teachings of the present invention as set forth herein may effect numerous modifications thereto. For example, it may in some instances be desired to eliminate the cap 52 from the container 48. In this instance the planar pivot surface 66 may be provided in any convenient manner on the body member 50. As an example the body may be provided with outwardly extending fins or the like which carry the surfaces 66 in a position thereon appropriate to coact with the pivot elements 100. Likewise, the stop element defined by the pin 70 may be suitably implemented by appendages to the body 50. These and other modifications are, however, to be be construed as line within the scope of the present invention as set forth in the appended claims.

What is claimed is:

1. A sample container for use in a centrifuge rotor having a pair of knife-like pivot edges therein comprising:

a body member having a sample-receiving volume therein;

a planar pivot surface on the body, the surface being adapted to operably engage along one diametrical dimension thereof each of the pivot edges for supported pivotal movement thereon from a first to a second position; and guide means on the container for guiding the same during the pivotal motion thereof.

2. The sample container of claim 1 wherein the container further comprises a cap removably connectable to the body member to afford access to the volume therein, the pivot surface being defined on the undersurface of the cap.

3. The sample container of claim 2 wherein the body has a central axis extending longitudinally therethrough and wherein the pivot edges engage the surface along an interrupted line contact that intersects the axis of the container.

4. The sample container of claim 3 wherein the rotor has a guide slot thereon and wherein the guide means comprises a guide pin on the cap adapted to cooperate with the guide slot on the rotor to guide the container during the pivotal movement thereof.

5. The sample container of claim 4 wherein the rotor has a stop surface thereon and wherein the pin on the cap is adapted to engage the stop surface to prohibit pivotal movement thereof past the second position.

6. The sample container of claim 3 wherein the rotor has a stop surface thereon and wherein the guide means is adapted to engage the stop surface to prohibit pivotal movement thereof past the second position.

7. The sample container of claim 3 wherein the rotor has a stress confining enclosing therearound and the body has a spherical surface at one end thereof abuttable in a force transmissive relationship with the enclosure.

8. The sample container of claim 2 wherein the rotor has a guide slot thereon and wherein the guide means comprises a guide pin on the cap adapted to cooperate with the guide slot on the rotor to guide the container during the pivotal movement thereof.

9. The sample container of claim 8 wherein the rotor has a stop surface thereon and wherein the pin on the cap is adapted to engage the stop surface to prohibit pivotal movement thereof past the second position.

10. The sample container of claim 2 wherein the rotor has a stop surface thereon and wherein the guide means is adapted to engage the stop surface to prohibit pivotal movement thereof past the second position.

11. The sample container of claim 2 wherein the rotor has a stress confining enclosing therearound and the body has a spherical surface at one end thereof abuttable in a force transmissive relationship with the enclosure.

12. The sample container of claim 1 wherein the body has a central axis extending longitudinally therethrough and wherein the pivot edges engage the surface along an interrupted line contact that intersects the axis of the container.

13. The sample container of claim 12 wherein the rotor has a guide slot thereon and wherein the guide means comprises a guide pin on the body adapated to cooperate with the guide slot on the rotor to guide the container during the pivotal movement thereof.

14. The sample container of claim 13 wherein the rotor has a stop surface thereon and wherein the pin on the body is adapted to engage the stop surface to prohibit pivotal movement thereof past the second position.

15. The sample container of claim 12 wherein the rotor has a stop surface thereon and wherein the guide means is adapted to engage the stop surface to prohibit pivotal movement thereof past the second position.

16. The sample container of claim 12 wherein the rotor has a stress confining enclosing therearound and the body has a spherical surface at one end thereof abuttable in a force transmissive relationship with the enclosure.

17. The sample container of claim 1 wherein the rotor has a guide slot thereon and wherein the guide means comprises a guide pin on the body adapated to cooperate with the guide slot on the rotor to guide the container during the pivotal movement thereof.

18. The sample container of claim 17 wherein the rotor has a stop surface thereon and wherein the pin on the body is adapted to engage the stop surface to prohibit pivotal movement thereof past the second position.

19. The sample container of claim 1 wherein the rotor has a stop surface thereon and wherein the guide means is adapted to engage the stop surface to prohibit pivotal movement thereof past the second position.

20. The sample container of claim 1 wherein the rotor has a stress confining enclosing therearound and the body has a spherical surface at one end thereof abuttable in a force transmissive relationship with the enclosure.

* * * * *